United States Patent [19]

Luo

[11] Patent Number: 4,809,648

[45] Date of Patent: Mar. 7, 1989

[54] TWO-STROKE ENGINE HAVING A CENTRAL SCAVENGING SYSTEM

[75] Inventor: Jih-Tzang Luo, Hsinchu Hsien, Taiwan

[73] Assignee: Industrial Technology Research Institute, Taiwan

[21] Appl. No.: 198,329

[22] Filed: May 25, 1988

[51] Int. Cl.[4] ..... F02B 75/02; F02F 3/24

[52] U.S. Cl. ..... 123/73 AA; 123/65 A; 123/73 PP

[58] Field of Search ..... 123/65 A, 65 V, 65 PD, 123/73 AA, 73 AV, 73 FA, 73 PP

[56] References Cited

U.S. PATENT DOCUMENTS

| | | | |
|---|---|---|---|
| 752,410 | 2/1904 | Ostergren | 123/73 AA |
| 856,647 | 6/1907 | Maud | 123/73 AA |
| 1,346,066 | 7/1920 | Spuhler | 123/73 AA |
| 1,535,433 | 4/1925 | Morrell | 123/73 AA |
| 1,664,782 | 4/1928 | Magdeburger | 123/73 AA |
| 3,257,998 | 6/1966 | Brooks | 123/73 AA |
| 4,135,479 | 1/1979 | Reitz et al. | 123/73 AA |
| 4,248,184 | 2/1981 | Maul | 123/73 AA |
| 4,329,948 | 5/1982 | Fujikawa et al. | 123/73 AA |

*Primary Examiner*—Willis R. Wolfe

*Attorney, Agent, or Firm*—Andrus, Sceales, Starke & Sawall

[57] ABSTRACT

Disclosed is a two-stroke engine having a central scavenging system through which the scavenging mixture, regulated into a single stream at a scavenging port provided in the top wall of the piston, jets upwardly into the center of the top portion of the cylinder bore and then spreads radially outwards so as to provide a plurality of currents of scavenging mixture. These currents branch from the main stream of scavenging mixture and flow through shorter distance as well as undergo similar flow environment with respect to one another due to symmetry in regard to the center of the cylinder. Thus, the scavenging performance of the two-stroke engine can be greatly improved.

2 Claims, 4 Drawing Sheets

TWO-STROKE ENGINE HAVING A CENTRAL SCAVENGING SYSTEM

FIELD OF THE INVENTION

This invention relates to a two-stroke engine adopting a central scavenging system in which scavenging mixture is introduced into the cylinder through a central scavenging port provided at the top portion of the piston so as to improve the scavenging performance of the engine.

BACKGROUND OF THE INVENTION

All existing two-stoke engines suffer from the common drawback that scavenging stroke and exhaust stroke occur in the same space and at the same time which will undoubtedly result in an undesirable but unavoidiable defect that a portion of the scavenging mixture of fuel and air ( hereinunder referred as "the mixture") will be discharged to the environment together with the combustion exhaust and thus reduce the combustion efficiency of the engine. Besides, if the exhaust port is closed before the interface of the mixture and the exhaust reaches it, part of the exhaust will be left behind in the combustion chamber and will inevitably reduce the scavenging efficiency. On the contrary, if the exhaust port remains open after the interfacing gas has passed through it, then, much mixture will, undesirably, escape into the environment together with the exhaust, thus reducing the combustion efficiency of the engine. Accordingly, it has, hitherto, been quite a difficult task to achieve simultaneously an optimum level of both the combustion efficiency and scavenging efficiency in a two-stroke engine.

Specifically, it is hard to catch the aforementioned interface of the mixture and the exhaust because the interface fluctuates according to different temperature, pressure and flow speed. Besides, the shape and length of the passage for scavenging mixture will also affect the speed for the interface to reach the exhaust port. In order to achieve a more complete scavenging effect, several scavenging ports and several scavenging passages are usually provided in the cylinder wall. However, since each current of scavenging mixture flows from one side to the other within the cylinder bore through a comparatively long distance (see FIG. 5 ), the shape and length of the various scavenging mixture currents vary considerably. Consequently, it is difficult to make all the various interfaces between the exhaust and each individual current of scavenging mixture to reach the exhaust port simultaneously so as to decide on the optimum best timing for opening and closing the exhaust port. By conducting numerous experiments and formulating subsequent design improvements in scavenging ports and scavenging passages, it is barely possible to make all the interfaces arrive at the exhaust port simultaneously at a selected engine RPM. However, this will never be possible for all engine revolutions.

In addition, according to the design of a conventional two-stroke engine, it is also difficult, if not impossible, to increase the power output and the combustion efficiency of the engine at the same time. This is due to the fact that the necessary requirement for increasing the power output is to increase the torque of the crank shaft at high engine revolution. However, since the "time area" of the exhaust port—the integral of the opening area of the exhaust port with respect o its opening time—must increase with each increment of the engine revolution, the exhaust port must be provided at higher position for higher RPM engine so that the exhaust port can be opened earlier, which will undoubtedly reduce the effective explosion thrust and, consequently, the combustion efficiency of the engine.

In view of the above-described drawbacks of conventional two-stoke engines, the primary object of this invention is to provide a two-stroke engine in which the scavenging operation is performed by the use of a single current of scavenging mixture which jets upwardly, from the central portion of the cylinder, into the top portion of the cylinder bore, and then spreads radially and outwardly. Since each current of scavenging mixture, branching from the central main stream of scavenging mixture, flows through a relatively short distance to the exhaust port and since each current is subject to similar conditions in its flow environment and flow passage length due to central symmetry, it is possible to make all the various interfaces between the exhaust and each current of scavenging mixture to reach the exhaust port at the same time. Besides, since the upward-flowing scavenging mixture and the downward-flowing exhaust have exactly opposite flow directions, clear-cut interfaces are expected to be formed between them which will greatly enhance the scavenging efficiency of the engine.

Another object of this invention is to provide a two-stroke engine in which the exhaust ports can be disposed at lower location, as compared with conventional two-stroke engines, due to the fact that each exhaust port has relatively larger opening area, the exhaust has relatively shorter flow passage to the exhaust port, as 15 well as the exhaust can be discharged more quickly. This makes it possible to enhance the effective explosion thrust and to minimize the mixture loss through the exhaust port. Accordingly, this invention can maximize the power output of the two-stroke engines without the corresponding reduction in their combustion efficiency.

Yet another object of this invention is to provide a two-stroke engine in which a combustion chamber is provided at the top portion of its piston. Cold mixture comprising air and atomized fuel drops is forced into the top portion of the cylinder through the combustion chamber during a scavenging stroke, and is later forced to return to the combustion chamber during a compression stroke. Accordingly, the piston can be cooled twice and also the fuel and air can be mixed twice, which will improve the cooling effect of the hot piston and enable a more homogeneous mixing of fuel and air. In addition, since the fuel droplets have the chance to be preheated by the hot piston so as to vaporize more completely before combustion, and since air and fuel can be more homogeneously mixed, more complete combustion at high engine revolution can thus be achieved.

This invention will now be illustrated in detail by referring to the following accompanying drawings.

Figure 2A:
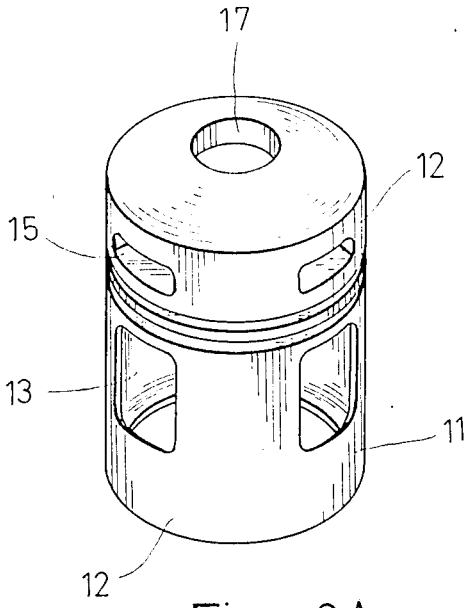
FIG. 2A is a perspective wiew of the piston within the engine as shown in FIG. 1.
Figure 2B:
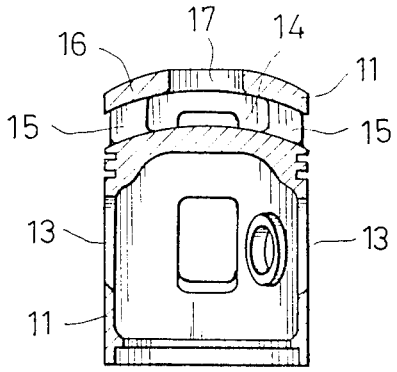
FIG. 2B is the longitudinal sectional view of the piston as shown in FIG. 2A.

The construction of the piston 1 in the two-stroke engine in accordance with this invention will now be described with reference to FIGS. 2A and 2B. The piston 1 comprises: a skirt portion 11 provided therethrough with a plurality of vents 13; and an upper portion 12 including a combustion chamber 14 in the interior thereof, with a plurality of scavenging inlets 15 being provided in the peripheral wall of the combustion chamber 14, and with a scavenging port 17 being provided in the central portion of the top wall 16 of the combustion chamber 14.

Figure 1:
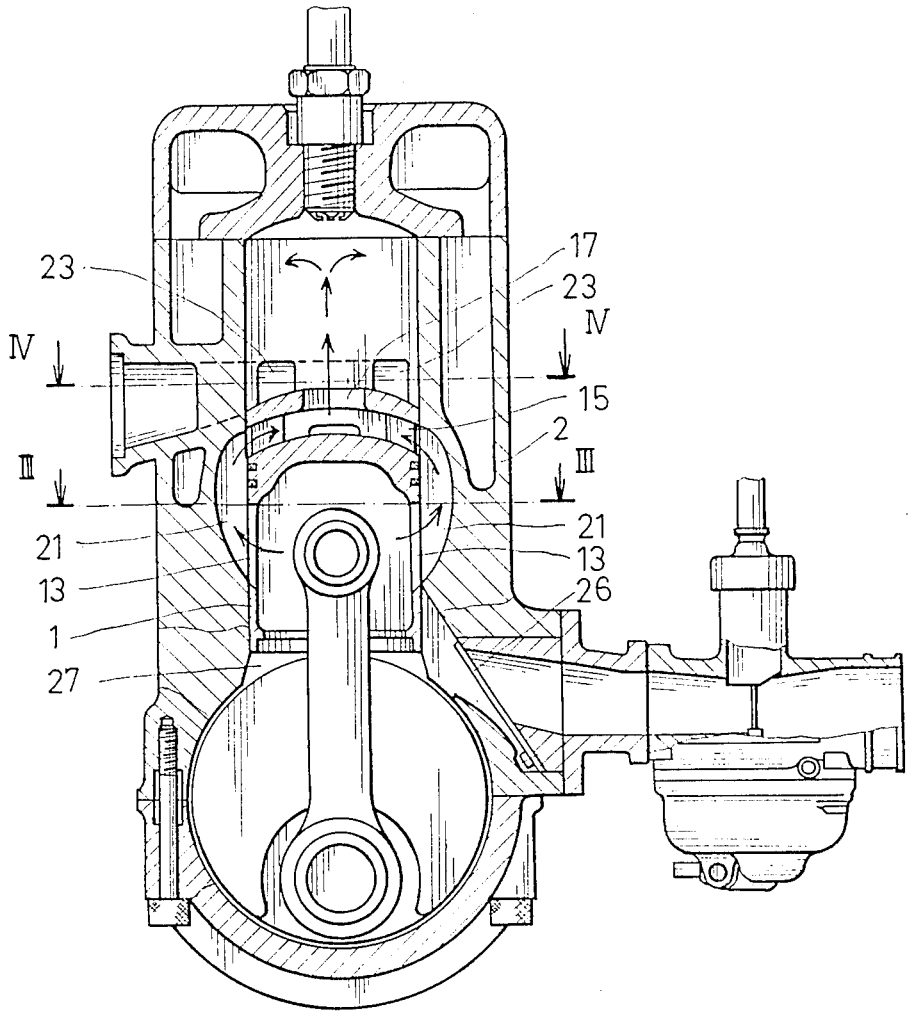
FIG. 1 is a cross-sectional view of a two-cycle engine in accordance with this invention, in which the piston is shown at the bottom-dead-center position.
Figure 3:
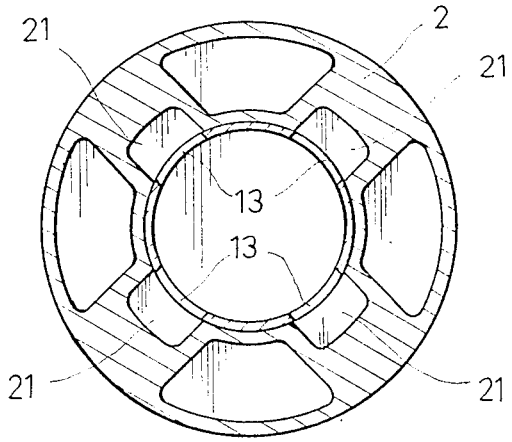
FIG. 3 is a cross-sectional view taken along the line III—III in FIG. 1.
Figure 4:
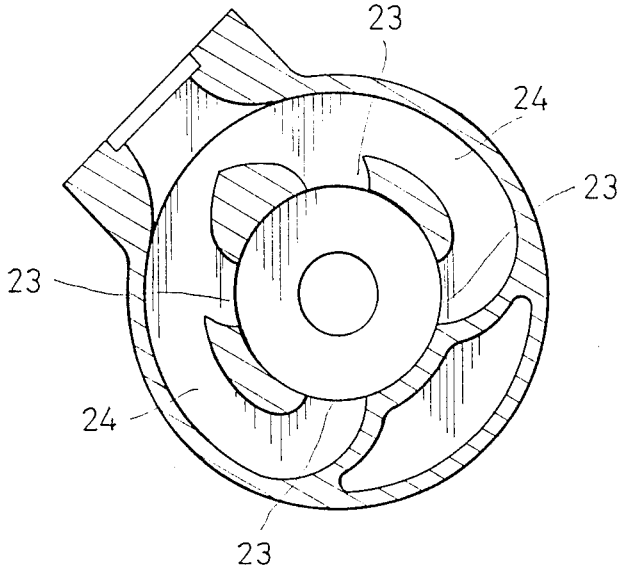
FIG. 4 is a cross-sectional view taken along the line IV—IV in FIG. 1.

Now, the construction of the cylinder 2 of an engine in accordance with this application will be described by referring to FIGS. 1, 3 and 4. But description with respect to parts having the same structure as those in a conventional two-stroke engine will be omitted. As best shown in FIG. 3, a plurality of scavenging recesses 21 are provided in the inner wall of the cylinder 2 near the crank case 27 of the engine. The scavenging recesses 21 are of the same number as the vents 13 provided through the skirt 11, and each recess 21 is radially aligned with a vent 13. When the piston 1 is in the vicinity of the bottom-dead center position as shown in FIG. 1, each scavenging recess communicates with a vent 13 and a scavenging inlet 15 provided in the piston 1. In addition, a plurality of exhaust port 23 are provided in the inner wall of the cylinder 2 above the scavenging recesses 21. The exhaust ports 23 should preferably be arranged at angular alternating positions with respect to the scavenging recesses 21. The exhaust ports 23 are located near the top portion of the piston 1 when the latter is at its bottom-dead-center position, and each has a relatively large opening area as compared with the case in a conventional two-stroke engine, which facilitates the quick departure of the combustion exhaust. These exhaust ports 23 are connected to exhaust manifolds ( not shown ) through exhaust channels 24 so that the combustion exhaust can be discharged outside of the engine.

The scavenging action in accordance with this invention will now be compared with that of a conventional two-stroke engine.

Figure 5:
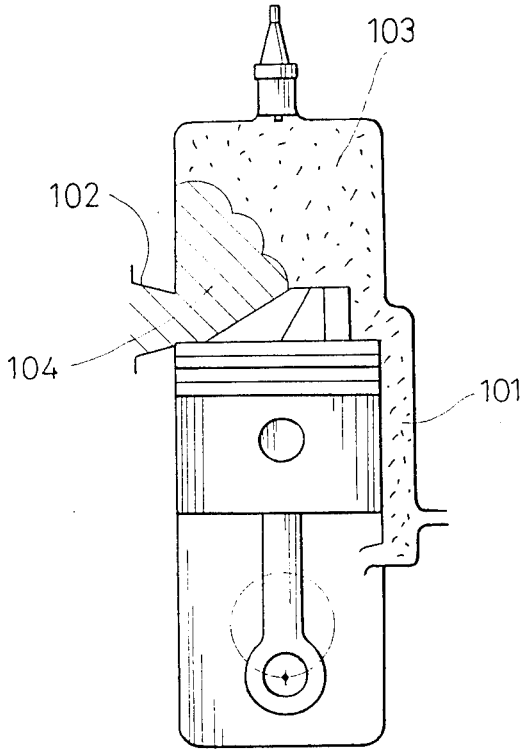
FIG. 5 is a schematic cross-sectional view of a conventional two-stroke engine showing how the scavenging action proceeds therein.

At first, the scavenging action of a conventional two-stroke engine will be roughly described with reference to FIG. 5. In a conventional two-stroke engine as schematically shown in FIG. 5, during the compression stroke of the fresh mixture 103 in the crank case, the resultant compressed mixture 103 will usually be forced through the scavenging channels 101 provided on one side of the cylinder bore into the combustion chamber and drives the combustion exhaust 104 to the opposite side of the cylinder bore so as to expel the exhaust outside of the engine through the exhaust ports 102.

Now, the scavenging mechanism and scavenging method of this invention will be illustrated mainly by referring to FIG. 1. In this invention, just like the case in a conventional two-stroke engine, the mixture for scavenging and combustion is introduced through an intake valve 26 into the crank case 27, and is compressed when the piston 1 moves downwardly.

However, according to this invention, the scavenging process is performed in a completely different way. When the piston 1 approaches its bottom-dead-center position, the crank case 27 begins to communicate with the top portion of the cylinder bore through the scavenging passages, each of which comprises a vent 13, a scavenging recess 21, a scavenging inlet 15 and a common scavenging port 17. During a scavenging stroke, the compressed mixture first enters the bottom of the piston 1, through each vent 13, scavenging recess 21 and then enters the combustion chamber 14 provided in the top portion of the piston 1 via each scavenging inlet , where the mixture is regulated into a single stream of mixture by the common scavenging port 17 provided above the combustion chamber 14 and jets upwardly into the center of the top portion of the cylinder bore, and then spreads radially outwards to replace the exhaust originally occupying the same space. The exhaust is driven away outwardly and downwardly and finally expelled outside of the engine through the exhaust ports 23, the exhaust channels 24 and the exhaust manifold (not shown).

In this invention, a unique scavenging mechanism is employed, according to which a single stream of mixture is jetted upwardly from the central portion of the cylinder into the top portin of the cylinder bore and then spreads outwardly to drive away and thus replace the combustion exhaust originally occupying the same space. Due to symmetry with respect to the center of the cylinder bore, all currents of mixture, branching from the original central single stream are subject to similar flow environment and flow through shorter distance as compared with the case of most conventional two-stroke engines where the mixture flows from one side to the opposite in the cylinder bore. With the unique scavenging mechanism, the various above-described improvements can thus be achieved.

Although this invention has been described with respect to a preferred embodiment, it is to be understood that this invention need not be limited, partly or wholly, to the disclosed embodiment. On the contrary, it is intended to cover all such modifications and similar arrangements included within the scope of the appended claims, the scope of which should be accorded the broadest interpretation so as to encompass all such modifications and similar structures.

What is claimed is:

1. A two-stroke engine with a central scavenging system, having a cylinder and a piston reciprocating within the cylinder, characterized in that:

said piston comprises: a skirt portion provided therethrough with a plurality of vents; and an upper portion including a combustion chamber in the interior thereof, said combustion chamber being surrounded by a top wall, a peripheral wall and a bottom wall, with a plurality of scavenging inlets being provided in said peripheral wall of said combustion chamber, and with a single scavenging port being provided in the central portion of said top wall of said combustion chamber; and that said cylinder comprises a crank case and a cylinder bore for receiving said piston and guiding the reciprocal movement of the latter, with a plurality of scavenging recesses being provided in the inner wall of said cylinder bore near said crank case, said scavenging recesses being of the same number and arranged at the same angular positions as said vents provided in said skirt, and with a plurality of exhaust ports being provided in the inner wall of said cylinder bore above said scavenging recesses; each scavenging recess communicating correspondingly with one of said vents and one of said scavenging inlets provided in said piston when said piston approaches its bottom-dead-center position;

whereby scavenging passages, each comprising one of said vents, one of said scavenging recesses, one of said scavenging inlets and said single scavenging port, are formed; and compressed scavenging mixture in said crank case may be forced to pass through said scavenging passages and jet upwardly into the top portion of said cylinder bore in the form of a single stream during a scavenging stroke.

2. A two-stroke engine as described in claim 1, wherein said exhaust ports are, respectively, arranged at angular alternating positions with respect to said scavenging recesses.

* * * * *